United States Patent [19]

Bains

[11] Patent Number: 4,685,639

[45] Date of Patent: Aug. 11, 1987

[54] PNEUMATICALLY ACTUATED RAM AIR STEERING SYSTEM FOR A GUIDED MISSILE

[75] Inventor: William R. Bains, Lake Elsinore, Calif.

[73] Assignee: Ford Aerospace & Communications Corp., Dearborn, Mich.

[21] Appl. No.: 812,208

[22] Filed: Dec. 23, 1985

[51] Int. Cl.[4] ..... F42B 15/033

[52] U.S. Cl. ..... 244/3.22

[58] Field of Search ..... 244/3.22

[56] References Cited

U.S. PATENT DOCUMENTS

| | | | |
|---|---|---|---|
| 2,324,551 | 7/1943 | Albree | 102/503 |
| 2,402,718 | 6/1946 | Albree | 244/3.1 |
| 2,836,378 | 5/1958 | Matthews | 244/3.21 |
| 2,977,879 | 4/1961 | Rice et al. | 102/49 |
| 2,989,922 | 6/1961 | Greenwood et al. | 102/49 |
| 3,091,924 | 6/1963 | Wilder, Jr. | 244/3.22 |
| 3,139,725 | 7/1964 | Webb | 60/35.54 |
| 3,145,949 | 3/1964 | Smith, Jr. | 244/3.21 |
| 3,208,383 | 9/1965 | Larson | 244/3.22 |
| 3,210,937 | 10/1965 | Perry, Jr. | 60/35.55 |
| 3,325,121 | 6/1967 | Banaszak et al. | 244/3.22 |
| 3,374,967 | 3/1968 | Plumley | 244/3.22 |
| 3,419,230 | 12/1968 | Mainhardt et al. | 244/3.23 |
| 3,502,285 | 3/1970 | Gambill | 244/3.22 |
| 3,749,334 | 7/1973 | McCorkle, Jr. | 244/3.22 |
| 3,854,401 | 12/1974 | Fisher | 102/70 |
| 3,977,629 | 8/1976 | Tubeuf | 244/3.22 |
| 4,003,531 | 1/1977 | Fink | 244/3.22 |
| 4,186,899 | 2/1980 | Stewart, Jr. | 244/3.13 |
| 4,211,378 | 7/1980 | Crepin | 244/3.22 |
| 4,328,938 | 5/1982 | Reisman et al. | 244/3.21 |
| 4,463,921 | 8/1984 | Metz | 244/3.22 |
| 4,522,357 | 6/1985 | Bains et al. | 244/3.22 |
| 4,573,648 | 3/1986 | Morenus et al. | 244/3.22 |
| 4,589,594 | 5/1986 | Kranz | 244/3.22 |

FOREIGN PATENT DOCUMENTS

| | | | |
|---|---|---|---|
| 1426963 | 12/1965 | France . | |
| 2508414 | 12/1982 | France . | |
| 8402975 | 8/1984 | PCT Int'l Appl. | 244/3.22 |
| 539224 | 9/1941 | United Kingdom . | |

*Primary Examiner*—Charles T. Jordan

*Attorney, Agent, or Firm*—Paul K. Godwin, Jr.; Clifford L. Sadler

[57] ABSTRACT

An opening in the nose of a missile allows entry of ram air during missile flight to a central chamber. Oppositely oriented steering jets are innerconnected with the aft end of the central chamber. A diverting mechanism is located between the central chamber and each of the steering jets to allow either one or none of the steering jets to provide correctional steering forces when desired. The rotatable diverting mechanism is pneumatically driven by ram air communicated to an actuation chamber located aft of the valve and controlled by electrically energized solenoids.

9 Claims, 6 Drawing Figures

PNEUMATICALLY ACTUATED RAM AIR STEERING SYSTEM FOR A GUIDED MISSILE

TECHNICAL FIELD

The present invention is directed to the field of missile control systems and more specifically to the area of projectile steering through the use of ram air for lateral thrust control.

BACKGROUND ART

Lateral steering control is an important feature in projectile guidance systems. In such systems, each projectile is fired from a gun or as a rocket towards a target and is guided to the target via an informational beam of energy radiated from a source, usually at the firing location. The information beam contains relative location codes by which the projectile, upon receipt of a particular code, will compute appropriate steering commands to correct its flight path. An example of a guidance system utilizing an informational beam is illustrated in commonly assigned U.S. Pat. No. 4,186,899.

Prior art techniques for providing steering control of projectiles and self-propelled missiles often employ nose mounted controllable fins, or side mounted thrust ports connected through adjustable control valves to self-contained sources of highly-pressurized gases. Conventionally, such sources are either common to the fuel source that propels the missile, or in the case of fired projectiles, are separately ignited by an auxiliary device and dedicated to the steering function. Examples of the common fuel source missile steering techniques are shown in U.S. Pat. No. 3,139,725 and U.S. Pat. No. 3,210,937. An example of a separate fuel source for lateral steering is shown in U.S. Pat. No. 3,749,334.

Commonly assigned U.S. Pat. No. 4,522,357 teaches the use of ram air entering a nose opening in a projectile, for effecting lateral steering thrust through oppositely oriented side openings by controlling the synchronous orientation of a ram air divering mechanism located between the nose opening and the side openings.

Co-pending and commonly assigned U.S. Pat. No. 4,573,648 describes a ram air steering system in which a combustion chamber, containing a solid fuel propellant, is located forward of the diverting mechanism to provide enhanced steering thrust forces when ignited by ram air.

SUMMARY OF THE INVENTION

The present invention is intended for use in the forward portion of a projectile type missile to provide controlled lateral thrust steering in an atmospheric environment.

The present invention utilizes ram air that enters a central chamber in the nose of the missile and is selectively diverted to one or the other of opposite and laterally positioned steering jets. The diverting means, in this instance, comprises a hollow, partially cylindrical element that act as as a shutter to selectively close both or control the opening of only one of two oppositely located (180°) steering ports. When no steering forces are required, both lateral thrust ports are closed. It has been found that by keeping both thrust ports closed and preventing ram air flow from occuring during a "no correction" condition, less aerodynamic drag is presented to the missile, allowing it to have a greater operating range.

The diverting means is mounted for rotation about its cylindrical axis and is rotatably controlled by electrical signals derived from an associated on-board signal receiver and logic/processor circuit. Although the receiver and circuit are not shown as part of the present invention, they function to provide appropriate steering correction signals to control the orientation of the diverting means, in accordance with the relative location information in the informational beam and vertical reference information derived from an on-board roll reference sensor. A roll reference sensor, such as that shown in commonly assigned U.S. Pat. No. 4,328,938, is appropriate to provide the necessary vertical reference information to the circuit.

Ram air pressure is communicated through the base of the diverting means to an actuation chamber. A vane element is normally balanced to a centered position by the ram air pressure within the chamber that in turn locates the diverting means to a position which closes both steering ports. A controlled imbalance in pressure within the actuation chamber will cause the diverting means to open a corresponding steering port.

DESCRIPTION OF THE PREFERRED EMBODIMENT

Figure 1:
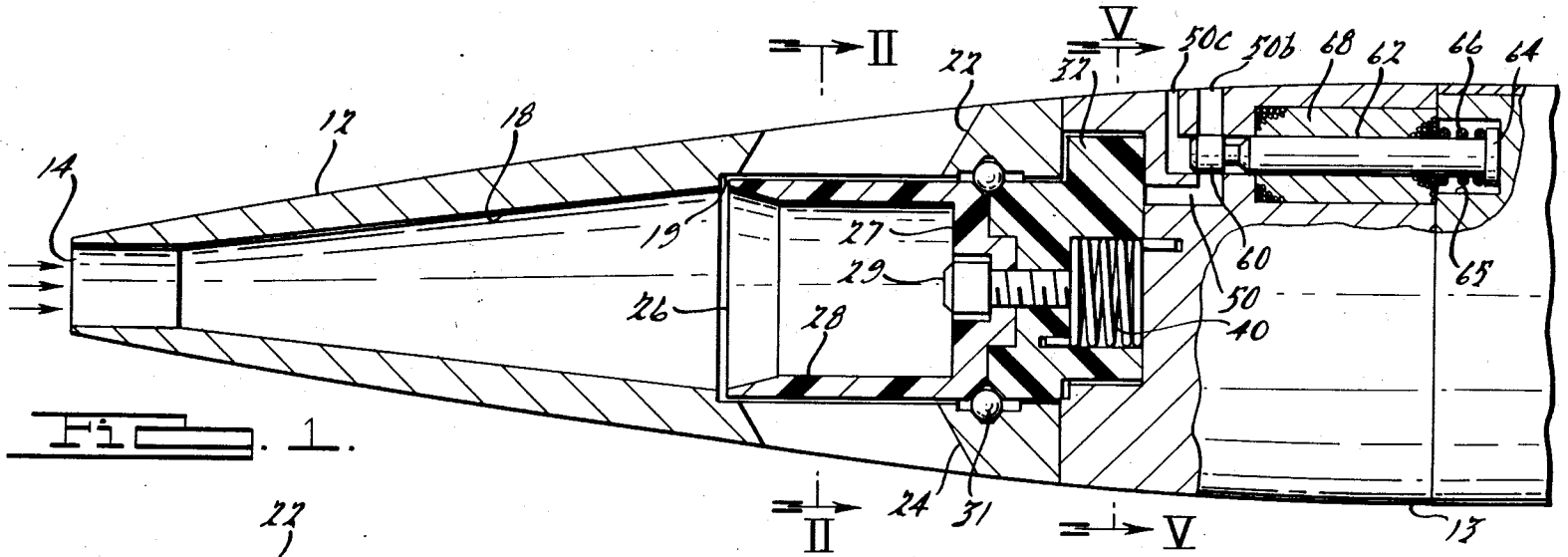
FIG. 1 is an elevational partial cross-section of the forward portion of a projectile incorporating the present invention.

An elevational cross-section of the forward end of a projectile type missile is shown in FIG. 1. The forward end includes a nose member 12 that is symmetrically formed to contain the preferred embodiment. The nose member 12 includes a ram air inlet 14 that opens to the forward end of a central cylindrical chamber 18. The aft end of the central chamber 18 is formed into separate passages that extend to diverging jet port openings 22 and 24 in opposite sides of the nose and define corresponding steering jets. The jet port openings 22 and 24 are oriented 180° apart and are slightly canted towards the rear of the missile so that escaping ram air produces thrust vectors "T" without contributing forward motion retarding components.

A partially cylindrical diverting element 26 is mounted on a single row ball bearing 31 so as to be rotatably positioned between the central chamber 18 and the jet port openings 22 and 24. The diverting element 26 is partially cylindrical in shape and is rotatable about its cylindrical axis, which is coaxial with the projectile axis of rotation. The diverting element 26 has an open end 19 that is in direct communication to receive ram air from the chamber 18. The side wall 28 of the diverting element 26 defines only a partial cylinder, due to an opening 27 that extends along its length. The opening 27 allows ram air to escape when it is oriented to be coincident with one or the other of the jet port openings 22 and 24. The solid portion of the partially cylindrical side wall 28 serves to block ram air from escaping through one or both of the jet port openings 22 and 24, depending on its orientation. Three different orientations of the divertng element 26 are shown in FIGS. 2, 3 and 4.

Figure 4:
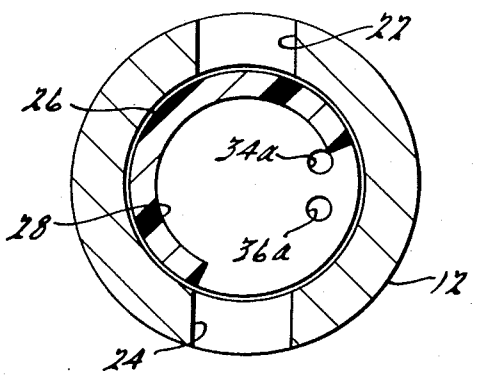
FIG. 4 is a cross-sectional view showing the diverting element located in a second position to divert ram air through a second side port.
Figure 3:
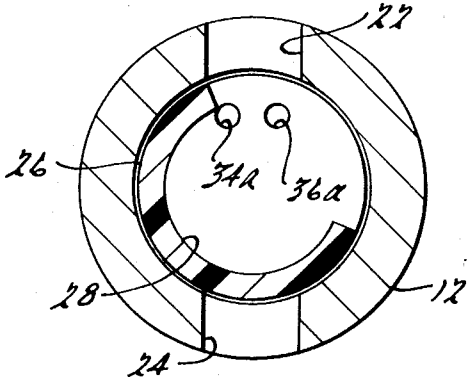
FIG. 3 is a cross-sectional view showing the diverting element located in a first position to divert ram air through a first side port.
Figure 2:
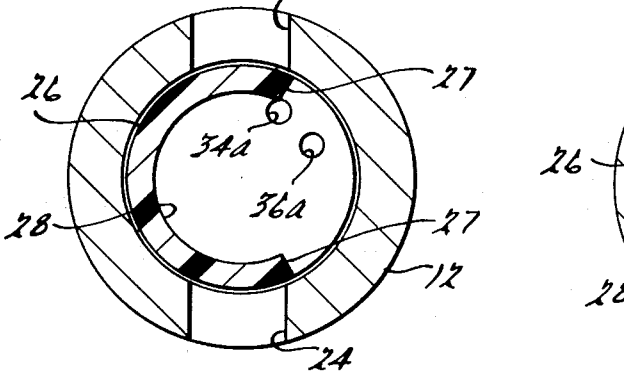
FIG. 2 is a cross-sectional view taken along lines II—II in FIG. 1, showing the diverting element located in a position that prevents ram air from being diverted to either side port.

Although the jet port openings of the nose member 12 are 180° apart, it can be seen from FIGS. 2, 3 and 4 that the diverting element 26 need only be rotated ±45° (approximately) from its centered or "closed" position to open either port. This minimal angular excursion allows for a relatively fast response time for the element 26.

The diverting element 26 is directly connected to a ram air powered vane motor by a centrally located fastener pin 29. The vane motor is partially defined by a rotor element 30 attached to the base 25 of the diverting element 26. The rotor element 30 contains a radially extending actuator vane 32 and a pair of ram air passages 34 and 36. The ram air passages extend from the base 25 of the diverting element 26 at respective openings 34*a* and 36*a* to respective openings 34*b* and 36*b* at either side of the vane 32.

An actuator housing 13 is located aft of the nose member 12 and is considered to be part of the generic "nose" of the associated missile. The nose member 12 is connected to the actuator housing with screw fasteners 62 provided in apertures 61.

A pneumatic actuation chamber 44 is provided in the actuator housing 13 to allow rotation of the actuated rotor element 30 through a total range of approximately 90° about the central axis. Actuation air vent passages 50 and 52 are provided in the actuator housing 13 so as to respectively extend from openings 50*a* and 52*a* in the actuation chamber 44 to actuator valve vent openings 50*b* and 52*b*.

Two separately controlled solenoid actuation valves 60 and 70 are located in the housing 13 so as to control the air pressure in the actuation chamber 44 and cause pneumatic rotation of the diverting element 26 ±45° from its centered, or "off" position. For ease of illustration, only the solenoid controlled actuation valve 60 associated with actuation air vent passage 50 is detailed in FIGS. 1 and 6. The associated actuation air vent passage 52 is shown in FIG. 6 with phantom lines to indicate its relative position and that of its associated solenoid controlled actuation valve 70.

Figures 5, 6:
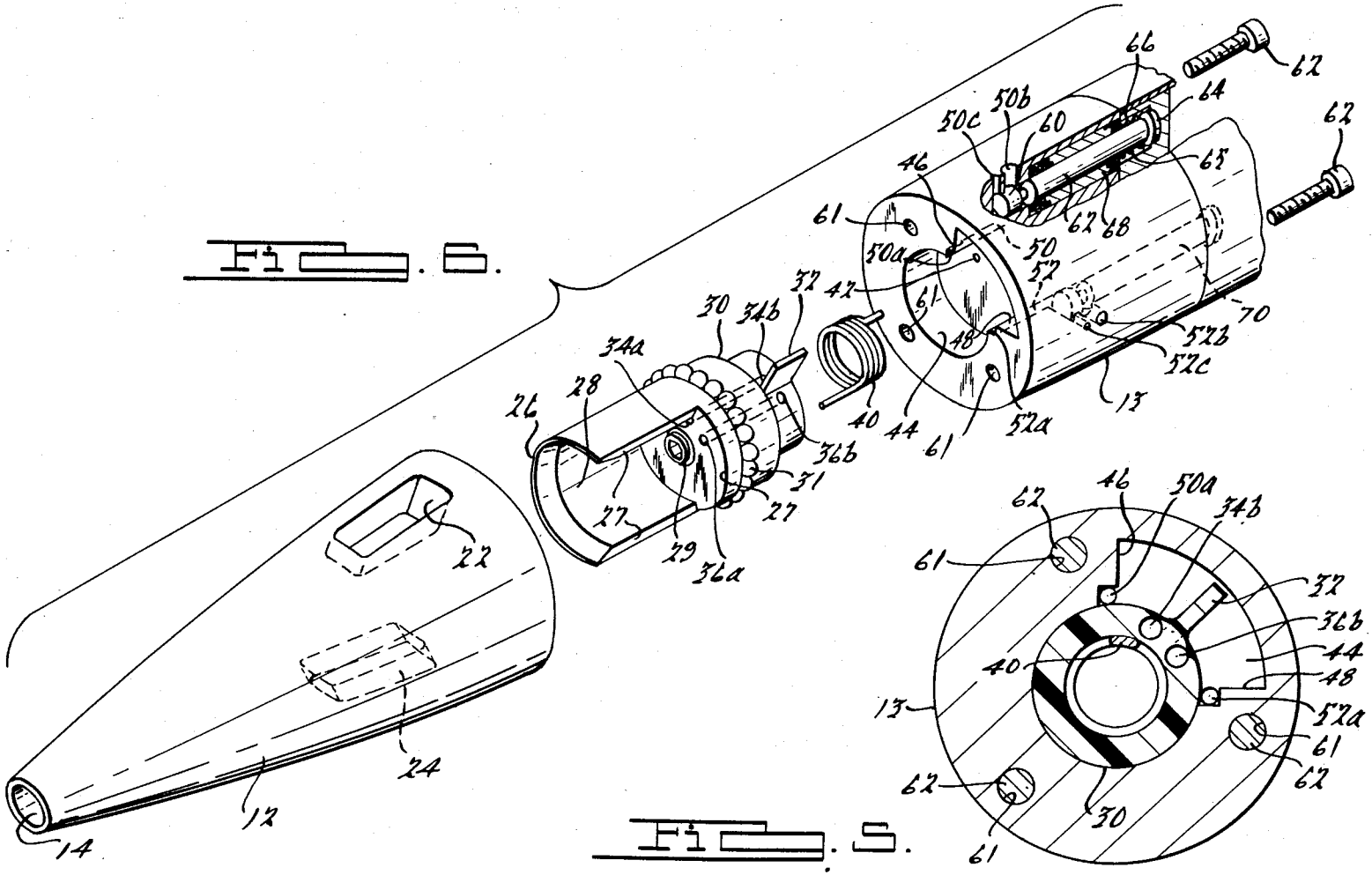
FIG. 5 is a cross-sectional view taken along lines V—V in FIG. 1 showing the actuator vane of the diverting element in its actuation chamber.
FIG. 6 is an exploded perspective view of the present invention.

In order to maintain the diverting element 26 and the vane 32 in their correspondingly centered positions, as shown in FIGS. 2 and 5, a centering coil spring 40 is provided with its ends connected between the housing 13 and the rotor element 30.

Shoulder walls 46 and 48 are formed in the actuation chamber 44 and are shown in FIGS. 5 and 6 to provide rotation limits for the vane 32 when actuated from its centered position. The actuation air vent passage openings 50*a* and 52*a* in the chamber 44 and the respective openings 34*b* and 36*b* adjacent to vane 32 are always in communication even when the vane 32 is actuated against one or the other of the shoulder walls 46 and 48.

The solenoid controlled valve 60 is directly connected to a reciprocally moveable plunger 67 which is spring bias by a coil spring 66 pushing against an end collar 64, within a chamber 65. In this manner, the valve 60 is normally held in a position which closes the actuation air vent passage opening 50*b*. The solenoid coil 68, when energized, causes the plunger 67 to move forward against the biasing of the spring 66 to cause the valve 60 to open the actuation air vent passage 50. An opening 50*c* is provided forward of the valve element 60 at a much smaller diameter than the opening at 50*b* so as to relieve any air pressure resistance to the movement of the valve 60.

In operation, as the missile is in flight within the atmosphere, ram air pressure is continually present within the nose section of the missile and, is present within the actuation chamber 44 on either side of the vane 32. When no steering corrections are ordered by the associated control system, solenoid valves are closed and pressures in the chamber 44 are balanced. The effect of the centering spring 40 is to hold the vane 32 in its centered position and cause the diverting element to block both jet port openings 22 and 24, as shown in FIG. 2.

When a steering correction is required so that ram air will be vented out of steering vent opening 22, an electrical signal is provided to the solenoid coil 68. The energized coil 68 causes the valve 60 to open and effect a drop in pressure within the chamber 44. The imbalance in pressure causes the vane 32 and rotor element 30 to immediately rotate against the bias of the spring 40 until the vane 32 contacts the shoulder 46. The diverting element 26 is simultaneously rotated so that its opening 27 coincides with the steering port 22, as shown in FIG. 3. When the solenoid coil 68 is deenergized, the spring 66 returns the valve 60 to its closed position. The closed valve in the vent passage 50 allows the pressure within the chamber 44 to be again balanced and the spring 40 will immediately return the vane 32 to its centered position and thereby return the diverting element 26 to its off position.

In order to rotate the divertng element 26 to the position shown in FIG. 4, the solenoid valve associated with the actuation vent passage 52 will be energized to open that passage and cause an imbalance in the actuation chamber 44, opposite to that described above.

The present invention, as embodied herein, is intended to be installed on projectiles or missiles which are allowed or caused to roll about their respective longitudinal axes during flight. In a particular installation, the projectile has a normal in-flight roll rate of approximately 1200 rpm (20 rps) in a clockwise direction. When, during flight, course correction is desired, each of the two thrust steering ports are alternately opened as the projectile rolls, and each port becomes oriented in a direction opposite to the desired course. Thus, two steering control thrust force pulses are available to effect course changes for each revolution a projectile makes at its normal roll rate (i.e., 40 force pulses per second).

It will be apparent that many modifications and variations may be implemented without departing from the scope of the novel concept of this invention. Therefore, it is intended by the appended claims to cover all such modifications and variations which fall within the true spirit and scope of the invention.

What is claimed is:

1. A system for directionally controlling a fired projectile spinning at a predetermined rate in a predetermined direction when traveling over its flight path comprising:

means at the nose end of said projectile for defining a cylindrical chamber having one end opened for receiving ram air;

a pair of oppositely disposed air passages extending from the chamber means to opposite sides of said projectile;

means between said chamber means and said passages for blocking ram air flow to both of said passages and for responsively diverting said ram air in a predetermined direction through one of said passages; and means for rotating said blocking and diverting means in a first direction to divert said ram air through a first one of said passages or in a second direction to divert said ram air through a second one of said passages to effect corresponding steering force thrust vectors.

2. A system as in claim 1, wherein said blocking and diverting means is a hollow partial cylinder having an open end to receive ram air and an opening in its cylinder wall to allow said ram air to be diverted through one of said passages when said opening is rotated by said rotating means to be coincident with said passage.

3. A system as in claim 2, wherein said blocking and cylinder wall of said diverting means substantially blocks both passages when said diverting means is not being rotated by said rotating means.

4. A system as in claim 3, wherein said blocking and diverting means is mechanically biased so as to substantially block both passages and said rotating means contains pneumatic means which responsively overcomes said mechanical biasing to rotate said blocking and diverting means.

5. A system as in claim 4, wherein said pneumatic means includes an actuation vane radially extending from beneath the base of said blocking and diverting means, an actuation chamber surrounding said actuation vane to limit the amount of rotation movement said blocking and diverting means may encounter, a biasing spring for biasing said vane in the approximate center of rotational movement defined by said actuation chamber, a pair of ram air passages extending from the base of said blocking and diverting means to either side of said actuation vane, a pair of vent passages extending from said actuation chamber to the side of said missile and valve means located within each vent passage to responsively open and close said vent passages.

6. A system as in claim 5, wherein said valve means is electrically controllable to responsively open and close said vent passages.

7. A system as in claim 2, wherein said blocking and diverting means is mechanically biased so as to substantially block both passages and said rotating means contains pneumatic means which responsively overcomes said mechanical biasing to rotate said blocking and diverting means.

8. A system as in claim 7, wherein said pneumatic means includes an actuation vane radially extending from beneath the base of said blocking and diverting means, an actuation chamber surrounding said actuation vane to limit the amount of rotation movement said blocking and diverting means may encounter, a biasing spring for biasing said vane in the approximate center of rotational movement defined by said actuation chamber, a pair of ram air passages extending from the base of said blocking and diverting means to either side of said actuation vane, a pair of vent passages extending from said actuation chamber to the side of said missile and valve means located within each vent passage to responsively open and close said vent passages.

9. A system as in claim 8, wherein said valve means is electrically controllable to responsively open and close said vent passages.

* * * * *

UNITED STATES PATENT AND TRADEMARK OFFICE

CERTIFICATE OF CORRECTION

PATENT NO. : 4,685,639

DATED : August 11, 1987

INVENTOR(S) : William R. Bains

It is certified that error appears in the above-identified patent and that said Letters Patent is hereby corrected as shown below:

The title page showing the illustrative figure should be deleted to appear as per attached title page.

Figs 1-6, should be deleted to be replace with Figs. 1-6, as show on the attached sheet.

Signed and Sealed this

Third Day of July, 1990

*Attest:*

*Attesting Officer*

HARRY F. MANBECK, JR.

*Commissioner of Patents and Trademarks*

United States Patent [19]

Bains

[11] Patent Number: 4,685,639

[45] Date of Patent: Aug. 11, 1987

[54] PNEUMATICALLY ACTUATED RAM AIR STEERING SYSTEM FOR A GUIDED MISSILE

[75] Inventor: William R. Bains, Lake Elsinore, Calif.

[73] Assignee: Ford Aerospace & Communications Corp., Dearborn, Mich.

[21] Appl. No.: 812,208

[22] Filed: Dec. 23, 1985

[51] Int. Cl.[4] ..... F42B 15/033

[52] U.S. Cl. ..... 244/3.22

[58] Field of Search ..... 244/3.22

[56] References Cited

U.S. PATENT DOCUMENTS

| | | | |
|---|---|---|---|
| 2,324,551 | 7/1943 | Albree | 102/503 |
| 2,402,718 | 6/1946 | Albree | 244/3.1 |
| 2,836,378 | 5/1958 | Matthews | 244/3.21 |
| 2,977,879 | 4/1961 | Rice et al. | 102/49 |
| 2,989,922 | 6/1961 | Greenwood et al. | 102/49 |
| 3,091,924 | 6/1963 | Wilder, Jr. | 244/3.22 |
| 3,139,725 | 7/1964 | Webb | 60/35.54 |
| 3,145,949 | 3/1964 | Smith, Jr. | 244/3.21 |
| 3,208,383 | 9/1965 | Larson | 244/3.22 |
| 3,210,937 | 10/1965 | Perry, Jr. | 60/35.55 |
| 3,325,121 | 6/1967 | Banaszak et al. | 244/3.22 |
| 3,374,967 | 3/1968 | Plumley | 244/3.22 |
| 3,419,230 | 12/1968 | Mainhardt et al. | 244/3.23 |
| 3,502,285 | 3/1970 | Gambill | 244/3.22 |
| 3,749,334 | 7/1973 | McCorkle, Jr. | 244/3.22 |
| 3,854,401 | 12/1974 | Fisher | 102/70 |
| 3,977,629 | 8/1976 | Tubeuf | 244/3.22 |
| 4,003,531 | 1/1977 | Fink | 244/3.22 |
| 4,186,899 | 2/1980 | Stewart, Jr. | 244/3.13 |
| 4,211,378 | 7/1980 | Crepin | 244/3.22 |
| 4,328,938 | 5/1982 | Reisman et al. | 244/3.21 |
| 4,463,921 | 8/1984 | Metz | 244/3.22 |
| 4,522,357 | 6/1985 | Bains et al. | 244/3.22 |
| 4,573,648 | 3/1986 | Morenus et al. | 244/3.22 |
| 4,589,594 | 5/1986 | Kranz | 244/3.22 |

FOREIGN PATENT DOCUMENTS

| | | | |
|---|---|---|---|
| 1426963 | 12/1965 | France . | |
| 2508414 | 12/1982 | France . | |
| 8402975 | 8/1984 | PCT Int'l Appl. | 244/3.22 |
| 539224 | 9/1941 | United Kingdom . | |

*Primary Examiner*—Charles T. Jordan

*Attorney, Agent, or Firm*—Paul K. Godwin, Jr.; Clifford L. Sadler

[57] ABSTRACT

An opening in the nose of a missile allows entry of ram air during missile flight to a central chamber. Oppositely oriented steering jets are innerconnected with the aft end of the central chamber. A diverting mechanism is located between the central chamber and each of the steering jets to allow either one or none of the steering jets to provide correctional steering forces when desired. The rotatable diverting mechanism is pneumatically driven by ram air communicated to an actuation chamber located aft of the valve and controlled by electrically energized solenoids.

9 Claims, 6 Drawing Figures

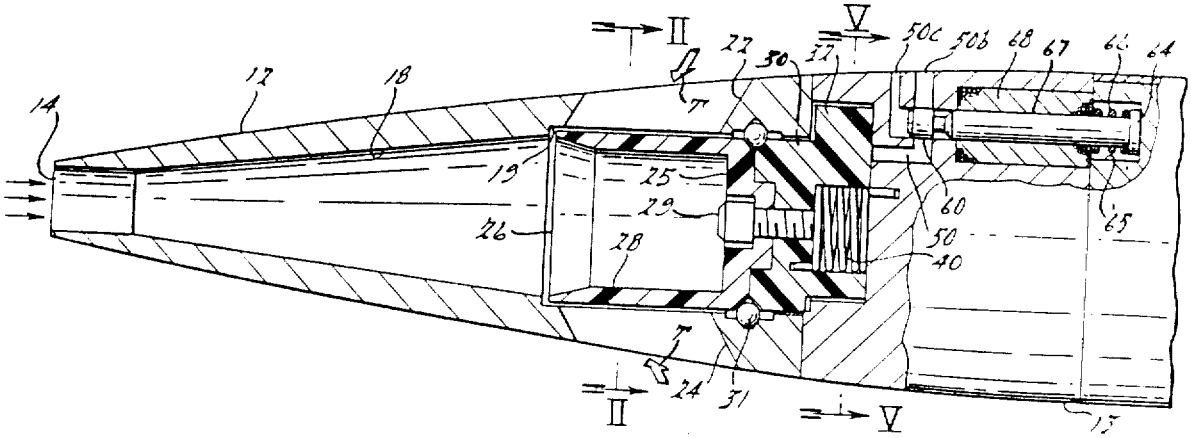

UNITED STATES PATENT AND TRADEMARK OFFICE

CERTIFICATE OF CORRECTION

PATENT NO. : 4,685,639

DATED : August 11, 1987

INVENTOR(S) : William R. Bains

It is certified that error appears in the above-identified patent and that said Letters Patent is hereby corrected as shown below:

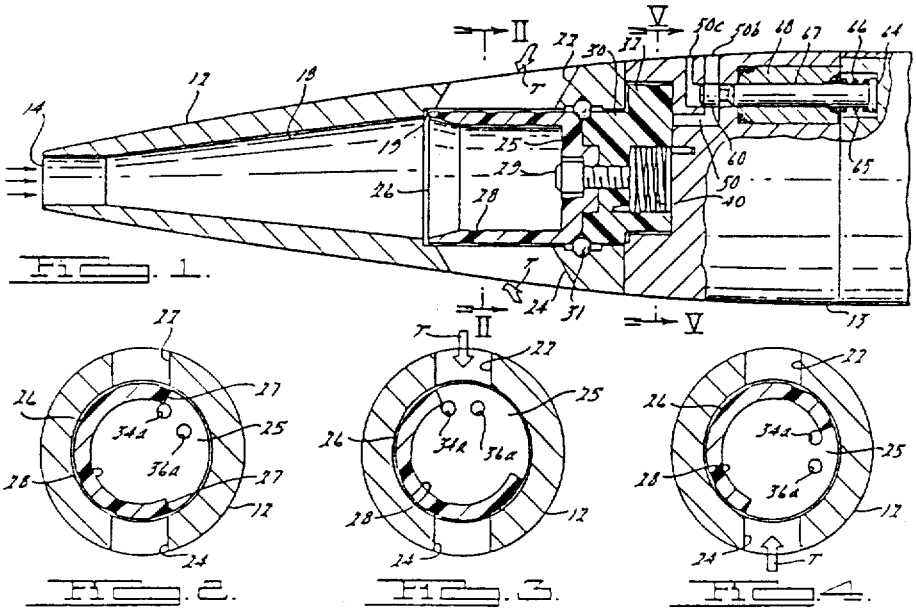

UNITED STATES PATENT AND TRADEMARK OFFICE

CERTIFICATE OF CORRECTION

PATENT NO. : 4,685,639

DATED : August 11, 1987

INVENTOR(S) : William R. Bains

It is certified that error appears in the above-identified patent and that said Letters Patent is hereby corrected as shown below:

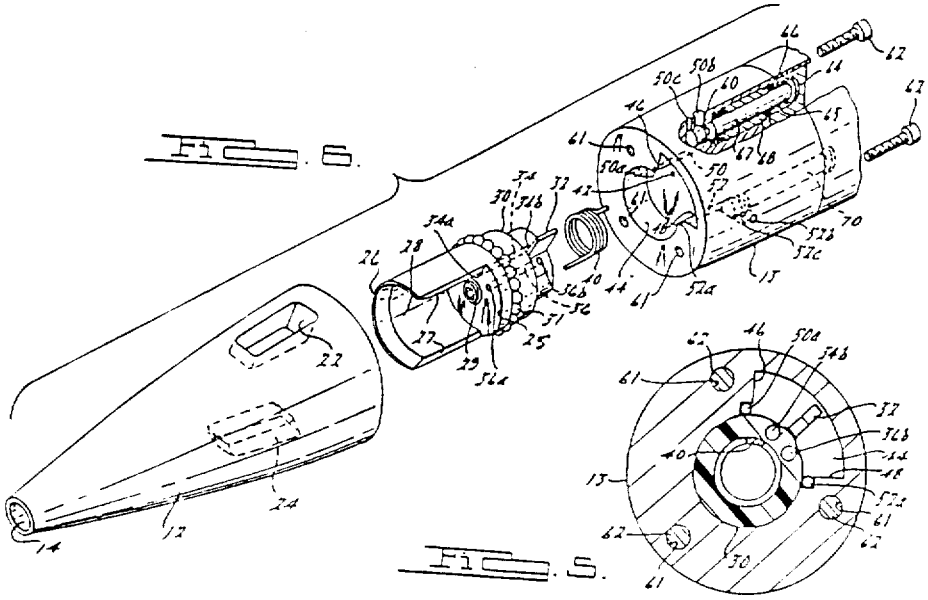

FIG. 6.

FIG. 5.